US010794032B2

(12) United States Patent
Jung et al.

(10) Patent No.: US 10,794,032 B2
(45) Date of Patent: Oct. 6, 2020

(54) NOISE MITIGATION SYSTEM

(71) Applicant: IHC HOLLAND IE B.V., Sliedrecht (NL)

(72) Inventors: Boudewijn Casper Jung, Bergen op Zoom (NL); Henricus Gerardus Andreas Van Vessem, Vught (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 0 days.

(21) Appl. No.: 15/540,889

(22) PCT Filed: Dec. 29, 2015

(86) PCT No.: PCT/NL2015/050917

§ 371 (c)(1),
(2) Date: Jun. 29, 2017

(87) PCT Pub. No.: WO2016/108692

PCT Pub. Date: Jul. 7, 2016

(65) Prior Publication Data

US 2018/0023266 A1 Jan. 25, 2018

(30) Foreign Application Priority Data

Dec. 29, 2014 (NL) ..... 2014069

(51) Int. Cl.
*E02B 17/02* (2006.01)
*E02D 7/02* (2006.01)
(Continued)

(52) U.S. Cl.
CPC ..... *E02D 13/005* (2013.01); *E02D 7/02* (2013.01); *E02B 17/00* (2013.01); *E02B 2017/0091* (2013.01); *E02D 27/525* (2013.01)

(58) Field of Classification Search
CPC ..... B63B 21/24; B63B 21/26; B63B 21/50; E02B 17/02; E02B 17/027; E02B 41/08; E02D 7/02; E02D 13/04; E02D 27/525
(Continued)

(56) References Cited

U.S. PATENT DOCUMENTS 2,953,904 A * 9/1960 Christenson ..... E02B 17/021 405/196
3,121,997 A * 2/1964 Sampson ..... E02B 17/021 405/211
(Continued)

FOREIGN PATENT DOCUMENTS

DE 1784396 B1 7/1971
EP 1640508 A1 3/2006
(Continued)

OTHER PUBLICATIONS

T.J. Carlson et al., "Hydroacoustic Measurements During Pile Driving at the Hood Canal Bridge, Sep. Through 1 Nov. 2004."
(Continued)

*Primary Examiner* — Edwin J Toledo-Duran
(74) *Attorney, Agent, or Firm* — Steven M. Koehler; Westman, Champlin & Koehler, P.A.

(57) ABSTRACT

A method of and a noise mitigation system for installing a foundation element, in particular a (mono)pile, includes a screen to be placed about a foundation element, in particular a (mono)pile, during driving of the foundation element in an underwater ground formation, to reduce noise input resulting from the driving into the surrounding water, e.g. a river or sea. The method and system comprise a further screen to be deployed about the (first) screen.

17 Claims, 1 Drawing Sheet

(51) Int. Cl.

| | |
|---|---|
| ***E02D 13/04*** | (2006.01) |
| ***E02D 13/00*** | (2006.01) |
| *E02B 17/00* | (2006.01) |
| *E02D 27/52* | (2006.01) |

(58) Field of Classification Search
USPC ..... 405/224, 225, 226, 227, 228
See application file for complete search history.

(56) References Cited

U.S. PATENT DOCUMENTS 3,213,629 A * 10/1965 Manning ..... E02B 17/0008 405/225
3,512,811 A * 5/1970 Moody ..... E02B 17/0008 285/288.1
3,601,999 A * 8/1971 Olsen ..... E21B 33/143 405/225
3,839,872 A * 10/1974 Loire ..... E02D 27/52 405/225
3,967,456 A * 7/1976 Stone ..... E02B 17/0008 405/225
4,041,718 A * 8/1977 Stone ..... E02B 17/0008 405/227
4,070,869 A * 1/1978 Williams ..... E02B 17/0008 405/225
4,077,224 A * 3/1978 Coone ..... E02B 17/0008 405/225
4,422,805 A * 12/1983 Sweatman ..... E02B 17/0008 405/222
4,552,486 A * 11/1985 Knox ..... E02B 17/0008 405/225
4,687,380 A * 8/1987 Meek ..... E02B 17/027 405/204
4,826,356 A * 5/1989 Brisco ..... E02B 17/0008 405/225
5,071,288 A * 12/1991 Brisco ..... E02B 17/0008 137/70
5,122,010 A * 6/1992 Burguieres, Jr. ..... E02B 17/027 405/204
5,658,656 A * 8/1997 Whitney ..... E04B 1/8218 181/198
6,567,341 B2 * 5/2003 Dreyer ..... B63G 13/02 181/296
8,500,369 B2 * 8/2013 Mohr ..... E02D 7/02 405/232
8,636,101 B2 * 1/2014 Elmer ..... E02B 17/0017 181/175
8,820,472 B2 * 9/2014 Jung ..... E02B 17/0013 181/196
8,876,486 B2 * 11/2014 Tosello ..... E04H 12/085 416/246
9,334,647 B2 * 5/2016 Elmer ..... E02D 13/00
9,488,026 B2 * 11/2016 Wochner ..... G10K 11/172
9,976,270 B2 * 5/2018 Elmer ..... E02B 3/062
10,138,714 B2 * 11/2018 Ward ..... E21B 41/0007
2008/0006478 A1 * 1/2008 Dreyer ..... F16L 55/0336 181/205
2009/0129871 A1 * 5/2009 Mohr ..... E02D 13/00 405/232
2011/0031062 A1 * 2/2011 Elmer ..... E02B 3/062 181/175
2011/0299938 A1 * 12/2011 Jung ..... E02D 13/00 405/228
2012/0097476 A1 * 4/2012 Jung ..... E02D 17/00 181/196
2012/0241039 A1 * 9/2012 Jung ..... E02D 7/14 138/155
2013/0056270 A1 * 3/2013 Ward ..... E21B 41/0007 175/5
2014/0169888 A1 * 6/2014 Johansson ..... E02D 7/14 405/232
2014/0241815 A1 * 8/2014 Hansen ..... E02D 13/00 405/248
2015/0078833 A1 * 3/2015 Elmer ..... E02D 13/005 405/195.1
2015/0078836 A1 * 3/2015 Stam ..... E02D 7/14 405/228
2015/0096830 A1 4/2015 Jung
2015/0110564 A1 * 4/2015 West ..... E02D 13/005 405/227
2015/0191987 A1 * 7/2015 Wochner ..... E21B 33/10 181/210
2017/0016199 A1 * 1/2017 Elmer ..... G10K 11/16
2017/0306582 A1 * 10/2017 Elmer ..... E02D 13/005

FOREIGN PATENT DOCUMENTS

| | | | |
|---|---|---|---|
| EP | 2395156 | A1 | 12/2011 |
| EP | 2441892 | A2 | 4/2012 |
| JP | S60159218 | A | 8/1985 |
| JP | 2014-517178 | A | 7/2014 |
| WO | 2007096132 | A1 | 8/2007 |
| WO | 2010151121 | A2 | 12/2010 |
| WO | 2013102459 | A2 | 7/2013 |
| WO | 2013154428 | A2 | 10/2013 |

OTHER PUBLICATIONS

International Search Report and Written Opinion for International patent application No. PCT/NL2015/050917, dated May 9, 2016.
Notice of Reasons for Rejection from the Japanese Patent Office for Japanese patent application No. 2017-534541, dated Jun. 24, 2019, with English translation.
English translation of Notice of Reasons for Rejection for Japanese Patent Application No. 2017-534541, dated Jun. 24, 2019.
European communication from the European Patent Office for European patent application No. 15837148.4, dated Jun. 3, 2020.
Sven Koschinski and Karin Ludemann, "Development of Noise Mitigation Measures in Offshore Wind Farm Construction", 2013, Commissioned by the Federal Agency for Nature Conservation, original report (in German) published Jul. 2011, updated Feb. 2013.

* cited by examiner

NOISE MITIGATION SYSTEM

CROSS-REFERENCE TO RELATED APPLICATION

The present application is a national stage of and claims priority of International patent application Serial No. PCT/NL2015/050917, filed Dec. 29, 2015, and published in English as WO 2016/108692 A1.

BACKGROUND

The discussion below is merely provided for general background information and is not intended to be used as an aid in determining the scope of the claimed subject matter.

An aspect of the invention relates to a method of installing a foundation element, in particular a (mono)pile, in an underwater ground formation by means of a driver, comprising the steps of placing a foundation element on the underwater ground formation, e.g. directly on a river- or seabed or on a scour protection or rock formation, placing a screen for reducing noise input from the driver into surrounding water, and driving the foundation element into the ground formation by means of the driver while the screen is positioned about the foundation element. Another aspect of the invention further relates to a noise mitigation system comprising a screen to be placed about a foundation element.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they in-tended to be used as an aid in determining the scope of the claimed subject matter. The claimed subject matter is not limited to implementations that solve any or all disadvantages noted in the Background.

A method comprises deploying, before driving the foundation element into the ground formation, a further screen about the (first) screen.

Surrounding the foundation element, during driving, by a first noise mitigation screen and at least a further noise mitigation screen, flexibility in optimizing and/or effectiveness of noise mitigation is improved. E.g., the first screen, the further screen and the distance between the screens can be optimized for mitigation of different frequency ranges. In an example, the first screen comprises a solid sleeve and the further screen is a bubble screen or comprises air chambers.

In an embodiment, the first screen provides a noise reduction of at least 15 dB, e.g. a noise reduction in a range from 17 to 25 dB, and the further screen provides a noise reduction of at least 5 dB, e.g. a noise reduction in a range from 6 to 15 dB.

In another embodiment, the further screen is deployed from the first screen, e.g. the further screen comprises a plurality of arms attached to the first screen and these arms are translated and/or rotated to deploy the further screen. Thus, the screens can be put in place as a whole and/or by means of the same equipment and, when the first screen is in place, the further screen can be folded out.

In another embodiment, a ring, continuous or intermittent, is placed about the first screen, e.g. on the ground formation, and a bubble screen is generated from the ring and/or a buoyant screen is suspended from the ring.

In an embodiment, the further screen is deployed with its bottom end below the bottom end of the first screen. In another embodiment, the further screen is deployed at a distance, measured between the outer circumference, e.g. the outer wall, of the first screen and the outer circumference, e.g. the outer wall or perimeter, of the further screen, of at least 3 meters, preferably at least 5 meters, preferably at least 7 meter, and/or preferably less than 50 meter, preferably less than 40 meters, preferably less than 30 meters, preferably less than 20 meters. Thus, the further screen can be deployed also about objects, such as a rock formation or scour protection, that the first screen is placed on or in and noise transmitted via such objects mitigated with the further screen.

An aspect of the invention further relates to a noise mitigation system comprising a screen to be placed about a foundation element, in particular a (mono)pile, during driving of the foundation element in an underwater ground formation, to reduce noise input resulting from the driving into the surrounding water, e.g. a river or sea, and a further screen to be deployed about the (first) screen.

In an embodiment, the further screen is attached to the first screen and movable between a retracted position and a deployed position, e.g. the further screen comprises a plurality of arms slidably and/or pivotably attached to the first screen, e.g. pivotable about a substantially vertical or a substantially horizontal axis.

In another embodiment, the further screen comprises a series of nozzles or a buoyant screen, e.g. a flexible tube comprising one or more buoys or air chambers.

In a refinement, the system comprises a tube or duct provided with a plurality of nozzles and attached near or at the ends of the arms, for generating a so-called bubble screen.

In another embodiment, the bottom end of the further screen is deployable below the bottom end of the first screen, e.g. by lowering the further screen from the first screen of by pivoting arms about horizontal axes over an angle between the arms and the first screen of more than 90°, preferably more than 100°. Surrounding e.g. a rock formation or scour protection is facilitated, if the further screen, e.g. the arms, is attached to the first screen at least 1 meter, preferably at least 2 meters, above the bottom end of the first screen.

BRIEF DESCRIPTION OF THE DRAWINGS

Aspects of the invention will now be explained in more detail with reference to the Figures, which show a preferred embodiment of the present method and system.

DETAILED DESCRIPTION

It is noted that the Figures are schematic in nature and that details, which are not necessary for understanding the present invention, may have been omitted.

Figure 1:
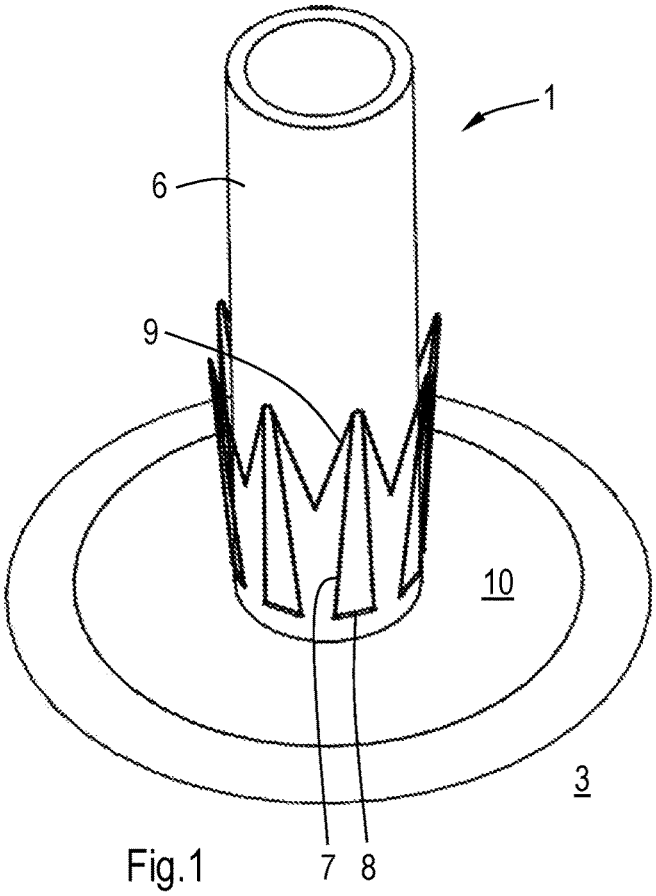
FIG. 1 is a perspective view of noise mitigation system comprising a further screen in a retracted position.

FIG. 1 shows an embodiment of a system 1 for installing a monopile 2 in an underwater ground formation 3, e.g. a seabed. In this example, the monopile 2 has a circular cross-section and a diameter of five meters and is intended to serve, after installation, as the foundation of a wind turbine.

Figure 2:
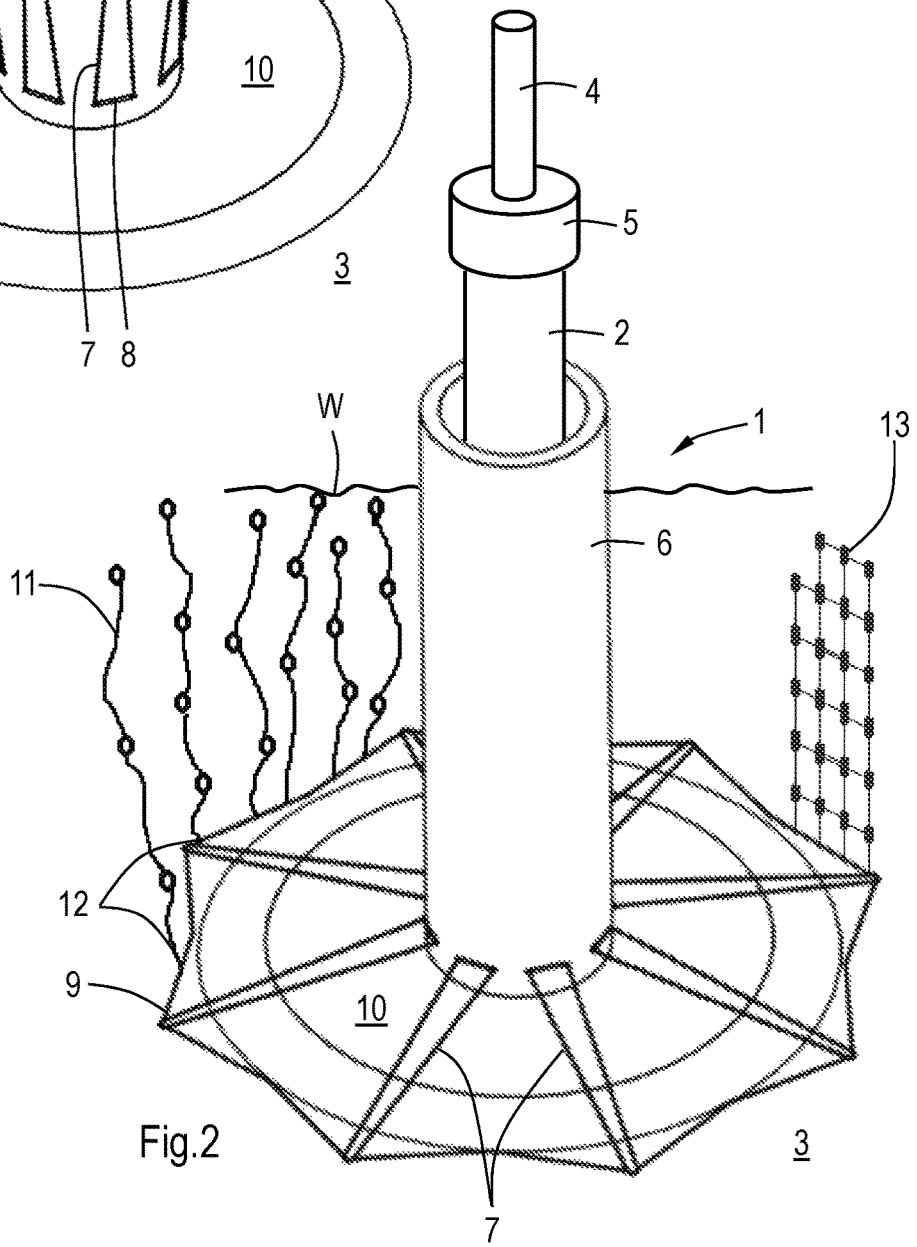
FIG. 2 is a perspective view of noise mitigation system comprising a further screen in a deployed position.

The system 1 comprises an hydraulic driver 4 (depicted in FIG. 2), e.g. an IHC Hydrohammer S-1800, connected to a power pack on board of a surface vessel, such as a ship or jack-up barge (not shown), a driver sleeve 5 for securely mounting the driver on the monopile and an anvil (hidden from view by the driver screen) for transmitting impact energy from the driver 4 to the monopile.

The system further comprises a noise mitigation screen 6, made of e.g. steel, to be placed about the foundation element to reduce noise input from the driver into the surrounding water. In this example, the screen comprises an inner wall and an outer wall, i.e. it is double walled, has a circular cross-section and an inner diameter of six meters. In general, it is preferred that, once in place, the sound-insulating screen extends to above the water level W.

The system comprises a further screen to be deployed about the screen 6. In this example, a plurality of arms 7 is attached to the first screen 6 by means of hinges 8 and hydraulic cylinders (not shown), such that the arms are pivotable about substantially horizontal axes. The arms 7 have a length of 15 meters and are made of e.g. metal rods or tubes. The hinges 8 are located approximately 2 meters above the bottom end of the first screen 6 and comprise torsion bars (not shown) to facilitate folding out and folding in. A flexible tube 9 is attached to the ends of the arms 7 and provided with a plurality of nozzles.

Installation of a monopile is carried out for instance as follows. The cables of the crane are attached to the upper end of a monopile stored on the deck of the ship and the monopile is lifted overboard, manipulated to an upright position, lowered onto the seabed or, as in this example, a scour protection 10. At this stage, the monopile is driven, e.g. by means of a vibratory device, into the scour protection and, depending on the circumstances, the seabed to a depth of some meters to further stabilize the monopile.

The driver 4 is positioned on top of the monopile 2 and the screen 6 is lifted over the monopile 2 and the driver 4 . Alternatively, the screen 6 is placed and the driver 4 is subsequently placed inside the screen 6 and on top of the pile. The further noise mitigation screen 9 is deployed by lowering the arms 7 onto the seabed. In this position, the tube forms a ring 9 that circumscribes the first screen 6 and the scour protection 10. By feeding air to the tube, e.g. by means of a pump on deck of a surface vessel and via one or more of the arms 7, a bubble screen is generated, which screen surrounds the scour protection 10 and the first screen 6.

Finally, the pile 2 is driven to the required depth and when driving is completed, the driver 4 is removed, the further screen 7, 9 retracted, the screens 6, 9 lifted over the pile 2 and placed back on deck or into the sea, and installation is completed.

The invention is not restricted to the embodiment described above and can be varied in numerous ways within the scope of the claims. In another embodiment, the further screen comprises a series of nozzles 12 or a buoyant screen 13, e.g. a flexible tube comprising one or more buoys or air chambers.

The ring 9-may provide sufficient weight to maintain the tube at an appropriate depth, e.g. with it bottom end on or in the seabed.

The invention claimed is:

1. A method of installing a foundation element in an underwater ground formation by means of a driver, comprising:

placing a foundation element on the underwater ground formation, placing a first screen for reducing noise input from the driver into surrounding water, driving the foundation element into the ground formation by means of the driver while the first screen is positioned about the foundation element, and deploying a further screen in the water before driving the foundation element into the ground formation, the further screen comprising a plurality of arms movably attached to the first screen and wherein deploying the further screen comprises moving the arms to deploy the further screen between a retracted position and a deployed position such that the further screen is deployed about the first screen at a distance of at least 3 meters, measured between an outer circumference of the first screen and an outer circumference of the further screen with water separating the first screen from the further screen.

2. The method according to claim 1, wherein deploying comprises deploying a ring about the first screen and generating a bubble screen as the further screen from the ring with water separating the bubble screen from the first screen.

3. The method according to claim 1, wherein deploying comprises deploying the further screen with its bottom end below the bottom end of the first screen.

4. The method according to claim 1, wherein the distance, measured between the outer circumference of the first screen and the outer circumference of the further screen, is at least 5 meters.

5. The method according to claim 1, wherein the first screen reduces noise by at least 15 dB and the further screen reduces noise by at least 5 dB.

6. The method of claim 1 wherein moving comprises translating the arms.

7. The method of claim 1 wherein moving comprises rotating the arms.

8. The method according to claim 1, comprising deploying a ring about the first screen and suspending a buoyant screen as the further screen from the ring with water separating the buoyant screen from the first screen.

9. A noise mitigation system comprising a first screen configured to be placed about a foundation element, during driving of the foundation element in an underwater ground formation, to reduce noise input resulting from the driving into the surrounding water and a further screen is attached to the first screen and comprises a plurality of arms movably attached to the first screen and configured so as to be deployed about the first screen by moving the arms between a retracted position and a deployed position such that in the deployed position the further screen is deployed with a distance between an outer circumference of the first screen and an outer circumference of the further screen of at least 3 meters.

10. The system according to claim 9, wherein the plurality of arms are slidably and/or pivotably attached to the first screen.

11. The system according to claim 9, wherein the further screen comprises a series of nozzles or a buoyant screen.

12. The system according to claim 11, wherein the further screen comprises a plurality of arms slidably and/or pivotably attached to the first screen and a tube provided with the series of nozzles, the tube being attached to the arms near or at ends of the arms.

13. The system according to claim 9, wherein a bottom end of the further screen is configured to be deployable below a bottom end of the first screen.

14. The system according to claim 9, wherein the further screen is attached to the first screen at least 1 meter above a bottom end of the first screen.

15. The system according to claim 9, wherein the further screen is configured so as to be deployed wherein the distance between the outer circumference of the first screen and the outer circumference of the further screen is at least 5 meters.

16. The system of claim 9 wherein the further screen comprises a plurality of arms pivotably attached to the first screen.

17. The system of claim 9 wherein the further screen comprises a buoyant screen.

* * * * *